United States Patent [19]

Otani

[11] Patent Number: 4,786,775

[45] Date of Patent: Nov. 22, 1988

[54] TURNTABLE DRIVING MOTOR FIXING STRUCTURE OF MICROWAVE OVEN

[75] Inventor: Akira Otáni, Yamatokoriyama, Japan

[73] Assignee: Sharp Kabushiki Kaisha, Osaka, Japan

[21] Appl. No.: 16,260

[22] Filed: Feb. 19, 1987

[30] Foreign Application Priority Data

Feb. 19, 1986 [JP] Japan ..... 61-23674[U]

[51] Int. Cl.[4] ..... H05B 6/78

[52] U.S. Cl. ..... 219/10.55 F; 219/10.55 E

[58] Field of Search ..... 219/10.55 F, 10.55 E, 219/10.55 D, 10.55 R

[56] References Cited

U.S. PATENT DOCUMENTS

| | | | |
|---|---|---|---|
| 3,626,135 | 12/1971 | Fitzmayer | 219/10.55 F |
| 4,429,204 | 1/1984 | McGuire et al. | 219/10.55 F |
| 4,591,682 | 5/1986 | Takeuji | 219/10.55 F |

*Primary Examiner*—Philip H. Leung

*Attorney, Agent, or Firm*—Birch, Stewart, Kolasch, & Birch

[57] ABSTRACT

In a microwave oven in which a motor rotates a turntable through a coupling detachably mounted on the outer bottom center of the turntable, a motor-fixing structure comprises a cylindrical bearing for covering the power transmission shaft around the portion near the motor in such a manner as to allow the shaft to be rotatable and to permit the coupling to be mounted on the shaft end. Threads are formed on the outer circumferential surface of the bearing and a through-hole is provided for insertion of the bearing into the oven. The through-hole is formed in the microwave oven bottom wall in the area facing the coupling mounting position and a nut is provided with top and bottom faces. Each of these faces are larger than the opening of the through-hole and the nut is made engaged with the threads of the bearing inserted through the through-ho;e and projecting into the oven, thereby fixing the motor.

3 Claims, 1 Drawing Sheet

TURNTABLE DRIVING MOTOR FIXING STRUCTURE OF MICROWAVE OVEN

BACKGROUND OF THE INVENTION

The present invention relates to a structure for fixing a turntable driving motor of a microwave oven, or more specifically to a simplified structure for fixing a turntable driving motor.

Conventionally, as shown in FIGS. 3 and 4, a motor (5*a*) or (5*b*) which drives, through a coupling (4*a*) or (4*b*), a turntable (3*a*) or (3*b*) rotatably supported by a roller (2*a*) or (2*b*) in an oven chamber (1*a*) or (1*b*) is fixed to the outer bottom of the oven chamber (1*a*) or (1*b*) by using a fixing bracket (6*a*) or (6*b*).

The fixing bracket (6*a*) or (6*b*) and the motor (5*a*) or (5*b*) define a closed (or choked) space (8*a*) or (8*b*) around the portion of the coupling (4*a*) or (4*b*) projecting outside the oven chamber (1*a*) or (1*b*). The closed space (8*a*) or (8*b*) communicates with the oven chamber (1*a*) or (1*b*) via a through hole (7*a*) or (7*b*) formed in the bottom wall of the oven chamber (1*a*) or (1*b*), whereby microwave leaking through the gap around the coupling (4*a*) or (4*b*) passed through the through-hole (7*a*) or (7*b*) is trapped within the oven. In addition to the complicated construction, the conventional device is defective in that it is expensive to manufacture the central portion of the bottom wall of the oven chamber (1*a*) or (1*b*) which must be raised above the rest portion to form the closed space (8*a*) or (8*b*).

SUMMARY OF THE INVENTION

In view of the above, an object of the present invention is to provide a turntable driving motor fixing structure of for a microwave oven which structure not only fixes the motor but also prevents microwave leakage with a simple arranged which is low cost in construction.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

In the microwave oven related to the present invention, a motor drives a turntable in the heating chamber of the microwave oven through a coupling detachably mounted in the outer bottom center of the turntable. According to an embodiment of the turntable driving motor fixing structure of a microwave oven of the present invention, the motor is provided with a cylindrical bearing which surrounds the power transmission shaft around the portion near the motor so as to allow the shaft to be rotatable and to permit the coupling to be mounted on the shaft end. The outer circumferential face of the bearing has threads. The bottom wall of the mirrowave oven's main body has a through-hole in the area facing the coupling mounting position, for insertion of the bearing. The bearing is inserted through the through-hole into the oven. A plate nut, whose top and bottom faces have greater areas than the through-hole, is engaged with the threads of the bearing projecting into the oven, thereby fixing the motor to the microwave oven main body.

Namely, according to the present invention, the motor is fixed to the oven by engaging the bearing threads projecting into the oven with the nut supported by the inner bottom surface of the oven.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

An embodiment of the present invention is described in detail below and with reference to the drawings.

Figure 1:
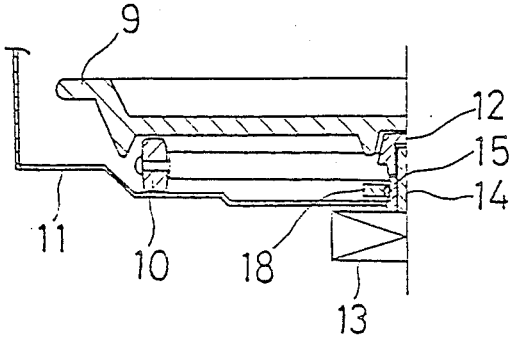
FIG. 1 shows a half section of the microwave oven turntable driving motor fixing structure of an embodiment of the present invention.
Figure 2:
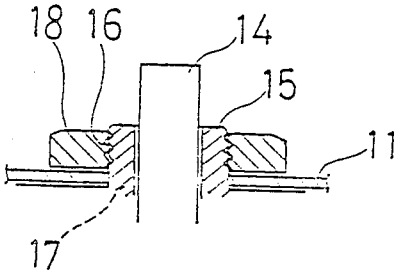
FIG. 2 is a sectional view of the motor bearing in the microwave oven turntable driving motor fixing structure of FIG. 1.
Figure 3:
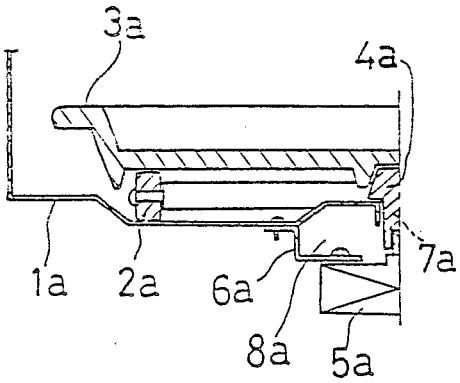
Fig. 3 PRIOR ART
FIGS. 3 and 4 show half sections of the conventional structures for fixing a turntable driving motor to a microwave oven.
Figure 4:
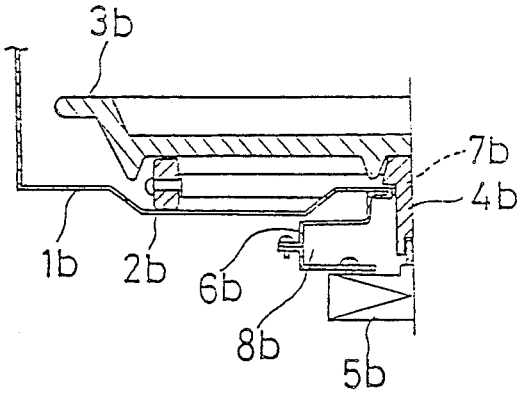
Fig. 4 PRIOR ART

FIG. 1 is a sectional view showing a half of the microwave oven turntable driving motor fixing structure of an embodiment of the present invention. In the microwave oven related to the present invention, an object (or food) to be heated is placed on a turntable in a heating chamber. When the oven switch is turned ON, the turntable is rotated by means of a motor while the object (or food) is heated by energy supplied from a heating source. A turntable (9) is provided in the microwave oven main body (not shown). The turntable (9) is rotatably supported byrollers (10) in the heating chamber or oven (11). A coupling (12) is detachably mounted on the outer bottom center of the turntable (9) which is driven through the coupling (12) by the motor (13). The motor (13) has a cylindrical bearing (15) which surrounds the power transmission shaft (14) around the portion close to the motor (13) so as to allow the shaft (14) to be rotatable and permit the coupling (12) to be mounted on the end of the shaft (14). Threads (16) are formed in the outer circumferential face of the bearing (15). A round through-hole (17) is formed in the bottom wall of the oven (11) in the area facing the coupling mounting position. The bearing (15) is inserted through the hole (17) and a disc nut (18) to be engaged with the threads (16) is provided. The disc nut (18) has a larger diameter than the throughhole (17).

The nut (18) may be of square shape provided that its top and bottom faces have an area larger than the opening of the through-hole (17).

The method of fixing the motor (13) by using the fixing structure of the present invention is described now.

First, the bearing (15) is inserted into the through-hole (17) so that the threaded portion (16) of the bearing (15) projects into the oven (11). Then, the nut (18) is engaged with the threads (16) whereby the motor (13) is fixed by the nut (18) supported by the oven inner bottom surface.

After the motor (13) is fixed, the coupling (12) is mounted on the power transmission shaft (14) and then the turntable (9) is placed on the coupling (12).

As understood from the above, the motor (13) is fixed simply by engaging the nut (18) with the threads (16).

Not only fixing the motor (13), but the nut (18) also closes the through-hole (17), thus preventing microwave from leaking outside the oven. Moreover, since the motor (13) can be fixed by the nut (18) alone, the motor-fixing structure of the present invention requires less parts than the conventional fixing structure.

As a result, a simple and low cost fixing structure is realized.

As described above, the present invention enables the motor to be fixed to the oven and microwave to be prevented from leaking by the simple and low cost structure.

In the above embodiment of the invention, the motor power transmission shaft is connected through the coupling with the turntable. Alternatively, it may be connected directly with the turntable.

While only certain embodiments of the present invention have been described, it will be apparent to those skilled in the art that various changes and modifications may be made therein without departing from the spirit and scope of the present invention as claimed.

What is claimed is:

1. In a microwave oven having a rotatable turntable having supporting means located at an outer edge thereof, a motor-fixing structure mounting a motor to the microwave oven, said motor-fixing structure comprising:

a bottom wall portion of said microwave oven having a through-hole therein, said bottom wall portion presenting a substantially flat surface extending from said through-hole to a raised portion of the oven which serves as a support for said supporting means;

a coupling mounted to a bottom side of said turntable;

a power transmission shaft extending from said motor to said coupling, said power transmission shaft transmitting drive from said motor to said turntable through said coupling to permit rotation of said turntable, said power transmission shaft extending through said through-hole;

a bearing surrounding said power transmission shaft and extending through said through-hole, said bearing having a threaded portion on an upper, outer end thereof, said bearing being attached to said motor, said bearing positioning said motor beneath said bottom wall portion for avoiding a closed space between said motor and said microwave oven; and an annular nut having a top face and a bottom face, each of said faces being larger than said through-hole, said nut having an inner opening with threads therein, said threads being engageable with the threaded portion of said bearing to affix said bearing to said nut and to form a seal therebetween, said nut when threaded to said bearing, closing said through-hole to prevent microwave leakage therethrough.

2. The motor fixing structure as recited in claim 1, wherein said coupling is detachably mounted to said turntable and wherein said nut when affixed to said bearing acts as the sole support for said motor such that said motor is fixed beneath said microwave oven.

3. In a microwave oven having a rotatable turntable and having a bottom portion having a through-hole therein, and having a motor-fixing structure mounting a motor to the microwave oven, said motor-fixing structure comprising;

a coupling detachably mounted to a bottom side of said turntable;

a power transmission shaft extending from said motor to said coupling, said power transmission shaft transmitting drive from said motor to said turntable through said coupling to permit rotation of said turntable, said power transmission shaft extending through said through-hole;

a bearing surrounding said power transmission shaft and extending through said through-hole, said bearing having a threaded portion on an upper, outer end thereof, said bearing being attached to said motor; and an annular nut having a top face and a bottom face, each of said faces being larger than said through-hole, said nut having an inner opening with threads therein, said threads being engageable with said threaded portion of said bearing to affix said bearing to said nut and to form a seal therebetween, said nut when threaded to said bearing, closing said through-hole to prevent microwave leakage therethrough, said nut when threaded to said bearing forming the sole support for holding said motor beneath said microwave oven.

* * * * *